US006455477B1

(12) United States Patent
L'Heureux

(10) Patent No.: US 6,455,477 B1
(45) Date of Patent: Sep. 24, 2002

(54) TWO-CYCLE LUBRICATING OIL WITH REDUCED SMOKE GENERATION

(75) Inventor: George C. L'Heureux, Scotch Plains, NJ (US)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 09/734,231

(22) Filed: Dec. 11, 2000

(51) Int. Cl.[7] ..... C10M 143/06; C10M 157/04

(52) U.S. Cl. ..... 508/287; 508/390; 508/502; 508/586

(58) Field of Search ..... 508/287, 390, 508/502, 586

(56) References Cited

U.S. PATENT DOCUMENTS

| | | | | | |
|---|---|---|---|---|---|
| 5,498,353 | A | * | 3/1996 | Lin et al. | 508/287 |
| 5,663,125 | A | * | 9/1997 | Ishimaru et al. | 508/194 |
| 5,741,764 | A | * | 4/1998 | Patel et al. | 508/459 |
| 5,888,948 | A | * | 3/1999 | Meny et al. | 508/591 |
| 5,912,214 | A | * | 6/1999 | Zehler et al. | 508/485 |
| 5,942,474 | A | * | 8/1999 | Tiffany et al. | 508/485 |
| 6,080,212 | A | * | 6/2000 | Beimesch et al. | 44/388 |

* cited by examiner

*Primary Examiner*—Jacqueline V. Howard

(57) ABSTRACT

There is disclosed a low smoke two cycle oil comprising a solvent and 5–20% by weight polyisobutylene which has a KV of at least 6.5 $mm^2/s$ at 100° C. and a JASO M342 Smoke Index of at least 85.

7 Claims, No Drawings

TWO-CYCLE LUBRICATING OIL WITH REDUCED SMOKE GENERATION

This invention relates to a lubricant composition useful as a two-cycle oil. More particularly the invention relates to two-cycle oil characterized in that it contains a relatively low amount of polyisobutylene, but provides an oil which complies with certain smoke generation test standards and viscosity requirements for land equipment, gasoline fueled, two-cycle engines, such as motorcycle engines, moped engines, snowmobile engines, lawn mower engines and the like. Two-stroke-cycle gasoline engines now range from small, less than 50 cc engines, to higher performance engines exceeding 500 cc. The development of such high performance engines has created the need for new two-cycle oil standards and test procedures.

Two-cycle engines are lubricated by mixing the fuel and lubricant and allowing the mixed composition to pass through the engine. Various types of two-cycle oils, compatible with fuel, have been described in the art. Typically, such oils contain a variety of additive components in order for the oil to pass industry standard tests to permit use in two-cycle engines.

The present invention is based on the discovery that the proper balance of a polybutene polymer, solvent and lubricating oil basestock can provide a two-cycle engine oil of suitable viscosity properties which exceeds the JASO (Japan Automobile Standards Organization) M342 Smoke Index test.

Accordingly, there has been discovered a two-cycle lubricating oil composition having a kinematic viscosity of at least 6.5 $mm^2/s$ (cSt) at 100° C. and a JASO M342 Smoke Index of at least 85 comprising an admixture of:

(a) 5 to 20% by weight of a polybutene polymer being a polybutene, polyisobutylene or a mixture of polybutenes and polyisobutylenes having a number average molecular weight of about 400 to 2200;

(b) 30 to 45% by weight of a normally liquid hydrocarbon or mineral oil solvent having a viscosity of 2 to 12 $mm^2/s$ (cSt) at 40° C.;

(c) 0 to 10% by weight of an additive package for two cycle lubricating oil additives such additives being present in such amounts to satisfy the JASO M345 detergency standards for two cycle lubricating oil compositions; and (d) the balance a lubricating oil having a viscosity of 20 to 180 $mm^2/s$ (cSt) at 40° C.

All percentages are by weight on an active ingredient basis based on the weight of the fully formulated lubricating oil composition, unless otherwise stated.

The mixture of polybutenes preferably useful in the lubricating oil compositions of this invention is a mixture of poly-n-butenes and polyisobutylene which normally results from the polymerization of $C_4$ olefins and generally will have a number average molecular weight of about 400 to 2200 with a polyisobutylene or polybutene having a number average molecular weight of about 400 to 1300 being particularly preferred, most preferable is a mixture of polybutene and polyisobutylene having a number average molecular weight of about 950. Number average molecular weight (Mn) is measured by gel permeation chromatography. Polymers composed of 100% polyisobutylene or 100% poly-n-butene are also within the scope of this invention and within the meaning of the term "a polybutene polymer". Preferably there is employed 10 to 20%, most preferably 12 to 15% by weight of the polybutene polymer.

A preferred polybutene polymer is a mixture of polybutenes and polyisobutylene prepared from a $C_4$ olefin refinery stream containing about 6 wt. % to 50 wt. % isobutylene with the balance a mixture of butene (cis- and trans-) isobutylene and less than 1 wt %. butadiene. Particularly, preferred is a polymer prepared from a $C_4$ stream composed of 6–45 wt. % isobutylene, 25–35 wt. % saturated butenes and 15–50 wt. % 1- and 2-butenes. The polymer is prepared by Lewis acid catalysis.

The solvents useful in the present invention may generally be characterized as being normally liquid natural or synthetic hydrocarbon or mineral oil solvents having a viscosity of 2 to 12, preferably 3 to 5 $mm^2/s$ (cSt) at 40° C. Such a solvent must also have a flash point in the range of about 60–120° C. such that the flash point of the two-cycle oil of this invention is greater than 70° C. Typical examples include paraffinic, isoparaffinic and naphthenic aliphatic hydrocarbon or mineral oil solvents. Such solvents may contain functional groups other than carbon and hydrogen provided such groups do not adversely affect performance of the two-cycle oil. Preferred is a paraffinic mineral oil solvent having a viscosity of 3.5 to 4.0 $mm^2/s$ (cSt) at 40° C. sold as "Sun HPO 40" by Sun Oil Company. Preferably, there will be employed 35–40% by weight of the solvent or a mixture of such solvents, such as 38 or 39%.

The proper balance of solvent and polybutene polymer is the essential aspect of the present invention. Traditionally in the two cycle lubricating field, formulations have required 22–30% polybutene polymer with a lower viscosity solvent such as kerosene in order to satisfy the JASO M342 Smoke Index value of at least 85. However, use of a relatively low viscosity solvent such as kerosene, while contributing to smoke performance, adversely affects kinematic viscosity (KV) which must be 6.5 $mm^2/s$ (cSt) or higher at 100° C. to meet JASO requirements for a commercially useful product. The formulation of this invention, which is kerosene-free, and free of solvents having viscosity less than 2.0 $mm^2/s$ (cSt) at 40° C., preferably less than 3.0 $mm^2/s$ (cSt) at 40° C., achieves a cost reduction by minimizing the amount of the polybutene polymer, an expensive ingredient, but at the same time satisfying the KV and JASO Smoke Index requirements.

The invention further comprises as a third component the presence of 0–10%, preferably 1–7%, by weight of an additive package which contains one or more conventional two-cycle lubricating oil additives, and these may be any additive normally included in such lubricating oils for a particular purpose.

Such conventional additives for the additive package component which may be present in the composition of this invention include corrosion inhibitors, oxidation inhibitors, friction modifiers, dispersants, antifoaming agents, antiwear agents, pour point depressants, metal detergents, rust inhibitors, lubricity agents, which are preferred, and the like. All percentages are by weight on an active ingredient (a.i.) basis.

A preferred additive package will comprise (i) polyisobutenyl (Mn 400–2500, preferably Mn 950) succinimide or another oil soluble, acylated, nitrogen containing lubricating oil dispersant present in such amount to provide 0.2–5 wt. %, preferably 1–3 wt. % dispersant in the lubricating oil and (ii) a metal phenate, sulfonate or salicylate oil soluble detergent additive, which is a neutral metal detergent or overbased such that the Total Base Number is 200 or less, present in such amount so as to provide 0.1–2 wt. %, preferably 0.2–1 wt. % metal detergent additive in the lubricating oil. The metal is preferably calcium, barium or magnesium. Neutral calcium salicylates are preferred present in amounts of about 0.5 to 1.5 wt. % in the lubricating oil.

Corrosion inhibitors are present in the oil in amounts of 0.01–3 wt. %, preferably 0.01–1.5 wt. %, and are illustrated by phosphosulfurized hydrocarbons and the products obtained by reacting a phosphosulfurized hydrocarbon with an alkaline earth metal oxide or hydroxide. Benzotriazole (35 wt. % active ingredient in propylene glycol) is preferred for use in this invention.

Oxidation inhibitors are present in the oil in amounts of 0.01–5 wt. %, preferably 0.01–1.5 wt. % and are antioxidants exemplified by alkaline earth metal salts of alkylphenol thioesters having preferably $C_5$–$C_{12}$ alkyl side chain such as calcium nonylphenol sulfide, barium t-octylphenol sulfide, dioctylphenylamines as well as sulfurized or phosphosulfurized hydrocarbons. Also included are oil soluble antioxidant copper compounds such as copper salts of $C_{10}$ to $C_{18}$ oil soluble fatty acids.

Friction modifiers are present in the oil in amounts of 0.01–3 wt. %, preferably 0.01–1.5 wt. %, and include fatty acid esters and amides, glycerol esters of dimerized fatty acids and succinate esters or metal salts thereof.

Pour point depressants, also known as lube oil flow improvers, are used in the oil in amounts of 0.01–2 wt. %, preferably 0.01–1.5 wt. %, and can lower the temperature at which the fluid will flow and typical of these additives are $C_8$–$C_{18}$ or $C_{14}$ dialkyl fumarate vinyl acetate copolymers, which are preferred, polymethacrylates and wax naphthalene.

Foam control can also be provided by an anti-foamant of the polysiloxane type such as silicone oil and polydimethyl siloxane; acrylate polymers are also suitable. These are used in the oil in amounts of 0.01–5 wt. %, preferably 0.01–1.5 wt. %.

Anti-wear agents reduce wear of metal parts and representative materials are zinc dialkyldithiophosphate, zinc diaryl diphosphate, and sulfurized isobutylene. These are used in the oil in amounts of 0.01–5 wt. %.

Lubricity agents useful in this invention may be selected from a wide variety of oil soluble materials. Generally, they are used in the oil in an amount of 1–20 wt. %, preferably 1–7% by weight. Lubricity agents include polyol ethers and polyol esters such as polyol esters of $C_5$–$C_{15}$ monocarboxylic acids, particularly pentaerythritol trimethylol propane and neopentyl glycol synlube esters of such acids, wherein the ester has a viscosity of at least 9 $mm^2/s$ (cSt) at 100° C., natural oils such as bright stock which is preferred and is the highly viscous mineral oil fraction derived from the distillation residues formed as a result of the preparation of lubricating oil fractions from petroleum.

The fourth component of the lubricating compositions of this invention is an oil of lubricating viscosity, that is, a viscosity of about 20–180, preferably 55–180 $mm^2/s$ (cSt) at 40° C., to provide a finished two-cycle oil having a KV in the range of 6.5–14 $mm^2/s$ (cSt) at 100° C.

These oils of lubricating viscosity for this invention can be natural or synthetic oils. Mixtures of such oils are also often useful. Blends of oils may also be used so long as the final viscosity is 20–180 $mm^2/s$ (cSt) at 40° C.

Natural oils include mineral lubricating oils, which are preferred, such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils.

Synthetic lubricating oils include hydrocarbon oils such as polymerized and interpolymerized olefins alkylated diphenyl ethers and alkylated diphenyl sulfides and the derivatives, analogs and homologs thereof.

Oils made by polymerizing olefins of less than 5 carbon atoms and mixtures thereof are typical synthetic polymer oils. Methods of preparing such polymer oils are well known to those skilled in the art as is shown by U.S. Pat. Nos. 2,278,445; 2,301,052; 2,318,719; 2,329,714; 2,345,574; and 2,422,443.

Alkylene oxide polymers (i.e., homopolymers, interpolymers, and derivatives thereof where the terminal hydroxyl groups have been modified by esterification, etherification, etc.) constitute a preferred class of known synthetic lubricating oils for the purpose of this invention, especially for use in combination with alkanol fuels. They are exemplified by the oils prepared through polymerization of ethylene oxide or propylene oxide, the alkyl and aryl ethers of these polyoxyalkylene polymers (e.g., methyl polypropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, octyl alcohol, dodecyl alcohol, tridecyl alcohol, 2-ethylhexyl alcohol, ethylene glycol, diethylene glycol monoether, propylene glycol, etc.). Specific examples of these esters include dioctyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{18}$ monocarboxylic acids and polyols and polyol ethers such as neopentyl glycol, trimethylol propane, pentaerythritol, dipentaerythritol, tripentaerythritol, etc.

Unrefined, refined and rerefined oils, either natural or synthetic (as well as mixtures of two or more of any of these) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from primary distillation or an ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes similar to those used to obtain refined oils which have been already used in service. Such rerefined oils are also known as reclaimed or reprocessed oils and often are additionally processed by techniques directed to removal of spent additives and oil breakdown products.

The lubricating oil compositions of the present invention will mix freely with the fuels used in such two-cycle engines. Admixtures of such lubricating oils with fuels comprise a further embodiment of this invention. The fuels useful in two-cycle engines are well known to those skilled in the art and usually contain a major portion of a normally liquid fuel such as a hydrocarbonaceous petroleum distillate fuel, e.g., motor gasoline is defined by ASTM specification D-439-73. Such fuels can also contain non-hydrocarbonaceous materials such as alcohols, ethers, organo nitro compounds and the like, e.g., methanol, ethanol, diethyl ether, methylethyl ether, nitro methane and such fuels are within the scope of this invention as are liquid fuels derived from vegetable and mineral sources such as corn, alpha shale and coal. Examples of such fuel mixtures are combinations of gasoline and ethanol, diesel fuel and ether, gasoline and nitro methane, etc. Gasoline is preferred, i.e., mixture of hydrocarbons having an ASTM boiling point of 60° C. at the 10% distillation point to about 205° C. at the 90% distillation point. Lead-free gasoline is particularly preferred.

The lubricants of this invention are used in admixture with fuels in amounts of about 20 to 250 parts by weight of fuel per 1 part by weight of lubricating oil, more typically about 30–100 parts by weight of fuel per 1 part by weight of oil.

The invention is further illustrated by the following examples which are not to be considered as limitative of its scope. "Active ingredient" or "a.i." refers to a solution of the additive in mineral oil, or other carrier where indicated. Percentages are by weight.

EXAMPLE 1

An oil of the invention was evaluated in accordance with the JASO M345 test procedures JASO M340, M341, M342 and M343. These are engine tests established by the Society of Automotive Engineers of Japan (JSAE) for two-cycle gasoline engine oils. As of Jul. 1, 1994, oils used in two-cycle engines are being labeled in accordance with the JASO-M345 standards as announced by the Japan Automobile Standards Organization (JASO). JASO published the JASO M345 standards in April, 1994. "EGD Detergency" is a reference to a further modification of the normal JASO M341 detergency test (1 hour) procedure in which the test is run for 3 hours. This is a more stringent standard expected to be adopted by ISO (the International Organization for Standardization) as published by Committee Draft of Jan. 5, 1995 of the Technical Committee 28. "FC" is the highest performance standard for the JASO M345 standards. Results are in the Table.

Notes for Table:

TABLE

| Component | Mass % |
|---|---|
| (a) Dispersant Adpack | 4.1 |
| (b) PIB of Mn 950 | 14.0 |
| (c) "Sun HPO-40" Solvent | 38.0 |
| (d) Antioxidant | 0.2 |
| (e) Rust Inhibitor | 0.2 |
| (f) Base Stock Oil | 38.5 |
| (g) Brightstock | 5.0 |
| | 100.0 |

TABLE-continued

| Analytical Testing | Method | Result | EGD/FC Limit |
|---|---|---|---|
| KV @ 100° C., $mm^2/s$ (cSt) | ASTM D445 | 6.86 | ≧6.5 |
| PM Flash Point, ° C. | ASTM D93 | 1.22 | ≧70 |
| Sulfated Ash, wt. % | ASTM D874 | 0.17 | ≦0.18 |
| ISO-EGD 3 Hr. Detergency Index | | 132 | ≧125 |
| ISO-EGD 3 Hr. Piston Varnish Index | | 102 | ≧95 |
| JASO 1 Hr. Detergency Index | | 104 | ≧95 |
| JASO 1 Hr. Piston Varnish Index | | 102 | ≧90 |
| JASO Lubricity Index | | 97 | ≧95 |
| JASO Initial Torque Index | | 100 | ≧98 |
| JASO Exhaust Smoke Index | | 92 | ≧85 |
| JASO Exhaust Blocking Index | | 95 | ≧85 |

(a) The Dispersant Adpack comprises 49% (50.5 wt. % active ingredient) of a Mn 950 polyisobutenyl succinimide dispersant, and 48.8% (40% active ingredient) of a neutral calcium salicylate detergent of TBN 58 and the balance a diluent mineral oil.

(b) "PIB" is polyisobutylene.

(c) The solvent is a paraffinic mineral oil and has a viscosity (KV) of 3.5–4.0 $mm^2/s$ (cSt) at 40° C.

(d) The antioxidant is a 30% a.i. solution of 4,4-methylene-bis-2,6-di-t-butyl phenol.

(e) The rust inhibitor is a 62% a.i. mineral oil solution of the reaction product of tetrapropyl succinic anhydride, propylene glycol and water.

(f) The basestock is "Sun CN 725" which has a viscosity of 127 $mm^2/s$ (cSt) at 40° C.

(g) The brightstock is Sun Brightstock, a lubricity agent.

EXAMPLE 2—COMPARATIVE

Another oil was prepared having the same composition as the oil of Example 1 except that the SUN HPO40 solvent was replaced with kerosene. This oil was unsatisfactory as a commercial product since it had a viscosity of 4.38 $mm^2/s$ (cSt) at 100° C., which is below the KV minimum of 6.5 $mm^2/s$ (cSt) at 100° C.

EXAMPLE 3—COMPARATIVE

Another oil was prepared which was the same as the oil of Example 1 except that it contained 45% of a paraffinic mineral oil solvent having a KV of 13 $mm^2/s$ (cSt) at 40° C., 7.0% of brightstock and 29.9% of "Exxon 600N" basestock, a basestock having a viscosity of 129 $mm^2/s$ (cSt) at 40° C. This oil was unsatisfactory since it was tested and found to have a JASO Smoke Index of 60. It had a KV of 9.07 $mm^2/s$ (cSt) at 100° C.

What is claimed is:

1. A two-cycle lubricating oil composition having a kinematic viscosity of at least 6.5 $mm^2/s$ (cSt) at 100° C. and a JASO M342 Smoke Index of at least 85 which consists essentially of an admixture of:

(a) 5 to 20% by weight of a polybutene polymer being a polybutene or polyisobutylene having a number average molecular weight of about 400 to 2200;

(b) 35 to 45% by weight of a normally liquid hydrocarbon or mineral oil solvent having a viscosity of 2 to 12 $mm^2/s$ (cSt) at 40° C.;

(c) 1 to 7% by weight of an additive package for two cycle lubricating oil additives such additives being present in such amounts to satisfy the JASO M345 standards for two cycle lubricating oil compositions and to provide 1 to 3 wt. % of a lubricating oil dispersant in said composition; and (d) the balance a lubricating oil having a viscosity of 55 to 180 $mm^2/s$ (cSt) at 40° C.

2. The composition of claim 1 wherein the (a) ingredient has an Mn of about 950.

3. The composition of claim 1 wherein the (b) ingredient is a paraffin mineral oil solvent having a viscosity of 3–5 2 $mm^2/s$ (cSt) at 40° C.

4. The composition of claim 1 wherein the (c) ingredient comprises a polyisobutenyl succinimide dispersant.

5. The composition of claim 1 wherein the (c) ingredient comprises a metal phenate, sulfonate or salicylate detergent having a Total Base Number 200 or less.

6. The composition of claim 1 wherein there is present about 12–15 wt. % of the (a) ingredient.

7. The composition of claim 1 wherein there is present 35–40 wt. % of the (b) ingredient.

* * * * *

UNITED STATES PATENT AND TRADEMARK OFFICE

CERTIFICATE OF CORRECTION

PATENT NO. : 6,455,477 B1
DATED : September 24, 2002
INVENTOR(S) : L'Heureux

It is certified that error appears in the above-identified patent and that said Letters Patent is hereby corrected as shown below:

Column 7,
Line 10, after "3-5" delete "2".

Signed and Sealed this

Eighteenth Day of March, 2003

JAMES E. ROGAN
*Director of the United States Patent and Trademark Office*